United States Patent [19]

Attey

[11] Patent Number: 4,660,489

[45] Date of Patent: Apr. 28, 1987

[54] SAILBOARD BOOMS

[76] Inventor: Graeme S. Attey, 61 Thelma St., Como, Western Australia, Australia, 6152

[21] Appl. No.: 838,419

[22] Filed: Mar. 10, 1986

Related U.S. Application Data

[63] Continuation of Ser. No. 615,797, May 31, 1984, abandoned.

[30] Foreign Application Priority Data

May 30, 1983 [AU] Australia ..... PF9605

[51] Int. Cl.[4] ..... B63B 35/72

[52] U.S. Cl. ..... 114/39; 114/89

[58] Field of Search ..... 114/39.2, 102, 103, 114/89, 97; 441/74

[56] References Cited

FOREIGN PATENT DOCUMENTS

| | | | |
|---|---|---|---|
| 2711633 | 9/1978 | Fed. Rep. of Germany | 114/39.2 |
| 2738374 | 3/1979 | Fed. Rep. of Germany | 114/39.2 |
| 3005067 | 8/1981 | Fed. Rep. of Germany | 114/39.2 |
| 3016154 | 10/1981 | Fed. Rep. of Germany | 114/39.2 |
| 8101365 | 10/1982 | Netherlands | 114/39.2 |

*Primary Examiner*—Joseph F. Peters, Jr.
*Assistant Examiner*—Edwin L. Swinehart
*Attorney, Agent, or Firm*—Reising, Ethington, Barnard, Perry & Milton

[57] ABSTRACT

The present invention relates to a sailboard boom which comprises first and second elongated members which are connected to one another adjacent their respective ends, wherein each elongated member comprises a portion having a vertical component relative to the general plane of the boom.

2 Claims, 6 Drawing Figures

SAILBOARD BOOMS

This application is a continuation of application Ser. No. 615,797 filed May 31, 1984 now abandoned.

The present invention relates to sailboard booms. Sailboard booms, which are sometimes referred to as wishbones, are conventionally of foil shape in plan view and flat in side elevation. Thus, in conventional booms, the only bends or curves are in a horizontal plane.

It follows that the vertical height of the mast at which the boom can be attached is governed by the height to which an operator can effectively reach and operate the boom. This height restriction limits the torque that the operator is able to apply to the mast through the boom.

Also, the fact that the conventional booms are flat means that an operator has only horizontal members to grasp. This forces the operator's arms, especially the leading arm, to adopt an undesirable position.

The present invention provides a sailboard boom in which the point of attachment to the mast may be higher than with conventional booms. Also, an operator may be able to position his leading arm in a better position than with conventional booms.

In accordance with one aspect of the present invention there is provided a sailboard boom which comprises first and second elongated members which are connected to one another adjacent their respective ends, wherein each elongated member comprises portion having a vertical component relative to the general plane of the boom.

Typically, the sailboard boom of the present invention comprises a first, leading end arranged to be attached to a mast of a sailboard and a second, trailing end arranged to be attached to a clew of a sailboard sail.

The portion having a vertical component is preferably closer to the first end than to the trailing end of the boom of the present invention.

Preferably, the boom of the present invention comprises a first generally flat portion adjacent the first end of the boom and a second generally flat portion adjacent the second end of the boom and an intermediate portion with a vertical component and which vertically spaces the first and second generally flat portions. However, it is possible to dispense with the first flat portion altogether so that the portion with a vertical component enters a mast end fitting directly.

The present invention will now be described, by way of example, with reference to the accompanying drawings, in which:-

Figure 1:
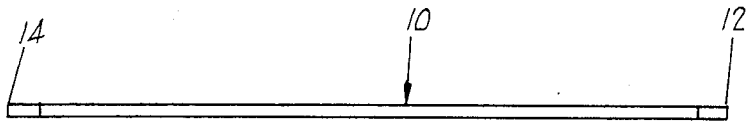
FIG. 1 is a side elevation of a conventional sailboard boom.
Figure 2:
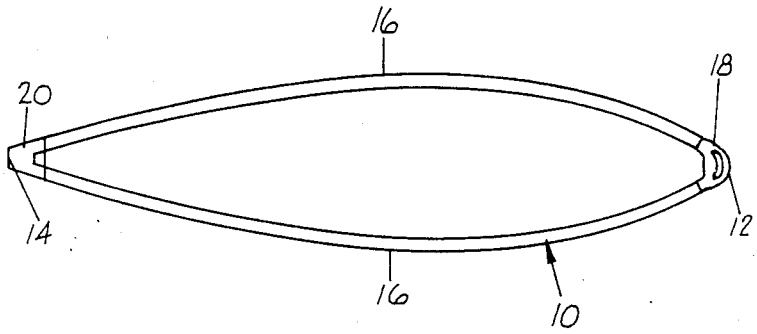
FIG. 2 is a plan view of the sailboard boom of FIG. 1.

In FIGS. 1 and 2 there is shown a sailboard boom 10 of conventional type and comprising a first, leading end 12 and a second, trailing end 14. The first and second ends 12 and 14 are interconnected by a pair of foil shaped elongated members 16.

The boom 10 is arranged at the first end 12 to be connected to a mast of a sailboard. In this connection the boom 10 is provided at the end 12 with a gooseneck 18. The gooseneck 18 is of known type and comprises a pair of sockets each arranged to receive an end of a respective elongated member 16.

Further, the boom 10 is arranged at the second end 14 to be attached to the clew of the sail of a sailboard by a rope outhaul. In this connection the boom 10 is provided at the second end 14 with a tailpiece 20. The tailpiece 20 comprises a pair of sockets each arranged to receive an end of a respective elongated member 16.

As can be seen in FIG. 1, the sailboard boom of FIGS. 1 and 2 has no curve or bend with a vertical component and is essentially flat. This leads to difficulties in use as described above.

Figure 3:
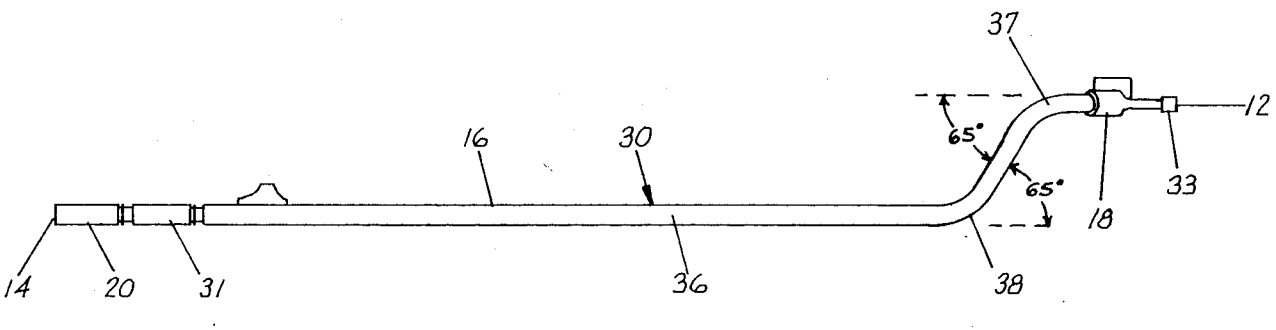
FIG. 3 is a side elevation of a sailboard boom in accordance with one embodiment of the present invention.
Figure 4:
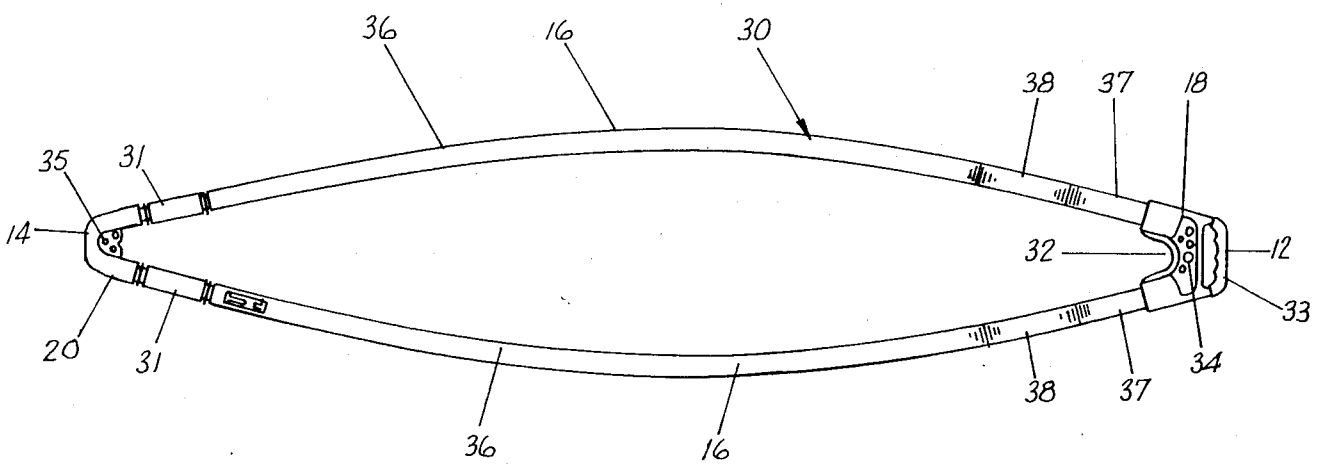
FIG. 4 is a plan view of the sailboard boom of FIG. 3.

In FIGS. 3 and 4 there is shown a sailboard boom 30 according to one embodiment of the present invention and like reference numerals are used to denote like parts to those found in FIGS. 1 and 2. The first and second ends 12 and 14 are interconnected by foil shaped elongated members 16.

Figure 5:
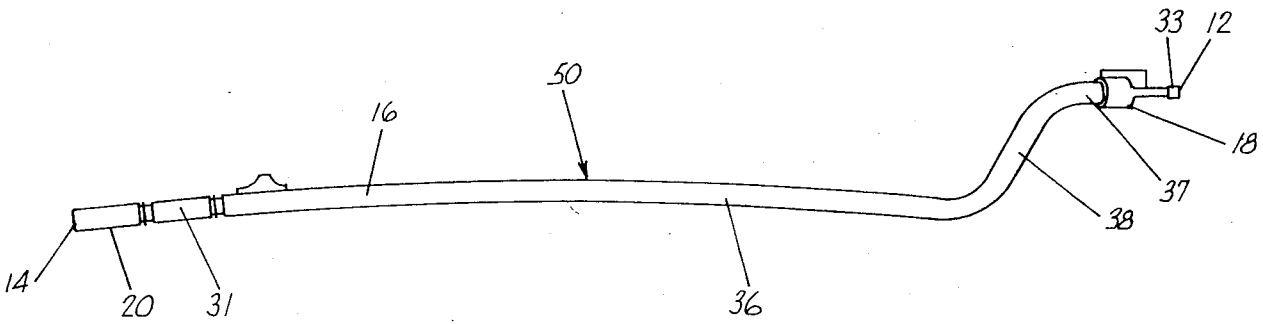
FIG. 5 is a side elevation of a sailboard boom in accordance with another embodiment of the present invention.

In FIG. 5, there is shown a sailboard boom 50 according to another embodiment of the present invention and like reference numerals are used to denote like parts to those found in FIGS. 1 and 2.

Reverting to FIGS. 3 and 4, it can be seen that the elongated members 16 each include length adjustment pieces 31 adjacent the tail piece 20. The length adjustment pieces 31 are each arranged to fit over smaller inserts in the tail piece 20 and the adjacent end of the elongated member 16.

Further, the gooseneck 18 comprises a central recess 32 which is arranged in use to receive a mast of a sailboard. The gooseneck 18 also can comprise a handle 33. The gooseneck 18 contains a number of small holes 34 which are arranged to receive a cord for attaching the mast to the boom 30 in known manner.

Similarly, the tail piece 20 contains a number of small holes 35 for attaching the clew of the sail to the boom 30 in known manner.

As can best be seen in FIG. 3, the elongated members 16 each comprises a second elongated flat portion 36 towards the second, trailing end 14 and a first flat portion 37 adjacent the first, leading end 12. Further, there is an intermediate portion 38 interconnecting the flat portions 36 and 37. The lower end of the intermediate portion 38 may be formed by bending a member 16 upwardly from the elongated flat portion 36 and the upper end of the intermediate portion 38 may be formed by bending the member 16 again so that the portion 37 is formed substantially parallel to the portion 36. Thus, the intermediate portion 38 generally comprises a major straight portion connected to the rest of the elongated member 16 by curved or bent portions.

Conveniently, the elongated members 16 are formed out of metal tubing which lends itself to being bent. Further, as can be seen in FIG. 4, the intermediate portion 38 of each elongated member 16 is opposed to the corresponding intermediate portion 38 of the other elongated member 16.

Similarly, each portion 36 and 37 of each elongated member 16 is opposed to the corresponding portions 36 and 37 of the other elongated member 16.

The intermediate portions 38 are preferably arranged so that they are substantially upright when in use. Typically, as shown in FIG. 3, the intermediate portions 38 are inclined to the portions 36 and 37 at an external angle in the range from about 45° to about 90° such as about 65°.

Further, the intermediate portion 38 is preferably of a length such that the portion 37 is higher than the portion 36 by about 115 mm to 400 mm such as by about 180 mm.

The boom 50 shown in FIG. 5, is similar to the boom 30 shown in FIG. 3 and 4 and like reference numerals denote like parts. However, it can be seen that the portion 36 is not coxpletely flat. The portion 36 is bowed upwardly so as to have an upper convex side which increases the longitudinal rigidity of the member 16. The curve imparted to the portions 36 of the members 16 is not great. In a typical case, the second, trailing end 14 of the boom 50 could be between about 10 mm and 50 mm lower than would be the case with a flat portion 36 as shown in FIG. 3 when the portion 37 was horizontal.

Figure 6:
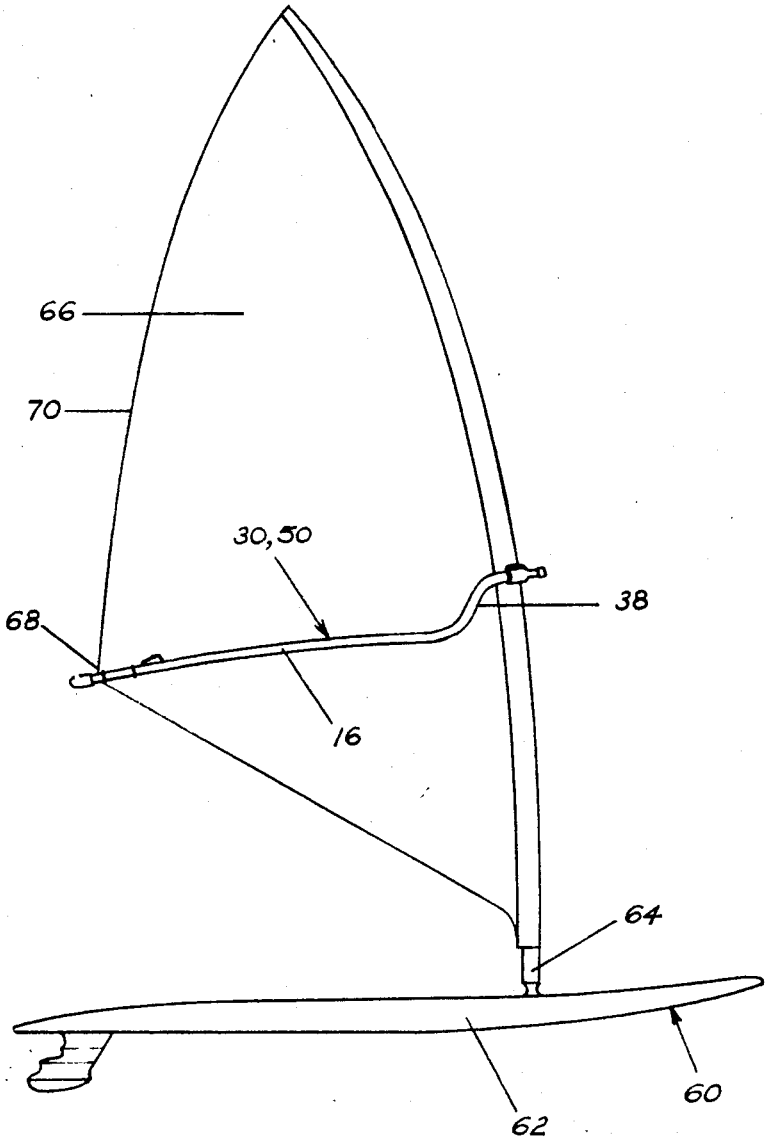
FIG. 6 is a side elevation of a sailboard provided with a boom in accordance with the present invention.

In FIG. 6, there is shown a sailboard 60 of known type comprising a board 62 having a mast 64 pivotally mounted thereon. A sail 66 is mounted to the mast 64. The sail 66 comprises a clew 68 and a leech 70.

As shown, a boom 30 or 50 in accordance with the present invention is attached to the mast 64 and the clew 68.

Sailboards travel for the most part with the mast foremost and the sail trailing. As can be seen in FIG. 6, the intermediate portion 38 of each member 16 is preferably located adjacent the mast 64. Thus, the portion 36 is preferably longer than the portion 37. Typically, the portion 36 is at least about 8 times as long as the portion 37.

The intermediate portion 38 enables an operator to grasp the boom with his leading hand (the hand closest to the mast 64) in a more natural and comfortable position than is the case with conventional booms.

With conventional booms the leading hand has to be held in a position with an uncomfortable, tiring twist in the forearm and wrist. With the boom of the present invention this problem is reduced because of the substantially vertical orientation of the intermediate portion 38.

The more comfortable leading hand position coupled with the fact that the mounting point of the boom to the mast may be higher, gives an operator precise, comfortable control over the sailboard and, if required, more power.

The advantages of the boom of the present invention are especially apparent when jumping, water starting and gybing because of the substantially vertical orientation of the intermediate portion 38, around which the rig can be made to pivot or rotate when desired.

If an uphaul is being used, the higher mast mounting point of the boom of the present invention reduces the effort needed to pull the sail assembly from the water.

Further, the higher mast mounting reduces mast bend which maintains sail shape and keeps the leech tighter. This results in more power, speed and an improved pointing ability.

Also, a boom of the present invention is stronger than a conventional boom because of the bending which is needed to produce the intermediate portion 38. The relatively long, flat portion 36 is shorter than conventional flat booms and therefore is less likely to bend or break.

Further, the boom of the present invention has greater vertical strength than conventional booms which in fact have very little strength capable of resisting vertical pressure Conventional booms also have outhaul sail tension transferred directly through long and weak foil shaped curves in a single plane. With the boom of the present invention, this tension is transferred across the length of the boom rather than out across the width of the boom producing stronger sail tension if required. Conventional booms tend to become shortened under load wich reduces sail tension. The boom of the present invention is more resistant to shortening under load so that a more constant sail tension can be achieved.

The tendency of the boom of the present invention to shorten under load is reduced still further by the provision of a downward curve in the portion 36 as shown in FIG. 5.

Thus, the strength of the boom of the present invention is enhanced by this feature.

Modifications and variations such as would be apparent to a skilled addressee are deemed within the scope of the present invention. For example, as described above the flat portion 37 could be dispensed with altogether so that the portion 38 entered a mast end fitting directly.

I claim:

1. A sailboard boom having a leading end for attachment to the mast of a sailboard and a trailing end for attachment to a clew of a sailboard sail, said boom comprising first and second elongated members each extending between said leading and trailing ends, said members being symmetrical and oppositely bowed between said leading and trailing ends to define open space devoid of obstructions between said members from leading end to trailing end for accommodating a sail therebetween, each of said members including goose-neck portions adjacent said leading ends thereof to define a short leading portion extending into a slanted portion extending downwardly and rearwardly to a long portion which is substantially longer than said short portion and generally parallel to said short leading portion for allowing an operator to grasp the slanted portion with the forward hand and the long portion at different positions therealong with the other hand.

2. A sailboard boom according to claim 1, in which the long portion is at least about eight times longer than the short leading portion.

* * * * *